US007434681B2

(12) United States Patent
Benderdouch

(10) Patent No.: US 7,434,681 B2
(45) Date of Patent: Oct. 14, 2008

(54) WETTING VESSEL FOR PAINT BRUSH AND PAINT BLOCKS EQUIPPED THEREWITH

(75) Inventor: Hamza Benderdouch, Choisy-le-Roi (FR)

(73) Assignee: BHM Diffusion, Choisy-le-Roi (FR)

( * ) Notice: Subject to any disclaimer, the term of this patent is extended or adjusted under 35 U.S.C. 154(b) by 289 days.

(21) Appl. No.: 10/522,312

(22) PCT Filed: Jul. 18, 2003

(86) PCT No.: PCT/FR03/02276

§ 371 (c)(1),
(2), (4) Date: Jan. 25, 2005

(87) PCT Pub. No.: WO2004/011277

PCT Pub. Date: Feb. 5, 2004

(65) Prior Publication Data

US 2005/0224371 A1 Oct. 13, 2005

(30) Foreign Application Priority Data

Jul. 25, 2002 (FR) ..... 02 09421

(51) Int. Cl.
*B05C 17/00* (2006.01)
*B44D 3/00* (2006.01)

(52) U.S. Cl. ..... 206/1.8; 206/209; 206/362; 15/257.05

(58) Field of Classification Search ..... 206/1.7–1.9, 206/205, 209, 229, 575, 361–362, 15.3; 15/209.1, 15/257.01–257.076; 312/31.1
See application file for complete search history.

(56) References Cited

U.S. PATENT DOCUMENTS

| | | | | |
|---|---|---|---|---|
| 2,255,628 | A * | 9/1941 | Rogers | |
| 2,936,473 | A * | 5/1960 | Karnes | 15/209.1 |
| 3,532,222 | A * | 10/1970 | Madden | |
| 3,786,913 | A * | 1/1974 | Crawford | |
| 4,494,267 | A * | 1/1985 | Fredley | |
| 4,638,909 | A * | 1/1987 | Ford | 206/1.7 |
| 5,244,090 | A * | 9/1993 | Keith | 206/361 |
| 5,318,171 | A * | 6/1994 | Szekely | |
| 5,540,363 | A * | 7/1996 | Wilson | 206/15.3 |
| 5,966,772 | A * | 10/1999 | Woodnorth et al. | 15/257.06 |
| 6,202,837 | B1 * | 3/2001 | Mason et al. | 206/209 |
| 6,325,206 | B1 * | 12/2001 | Stonex | 206/1.8 |
| 6,530,470 | B2 * | 3/2003 | Roundy | 206/209 |
| 2003/0150746 | A1 * | 8/2003 | Mendelsohn | 206/1.7 |
| 2005/0061709 | A1 * | 3/2005 | Sieling | 206/1.8 |

* cited by examiner

*Primary Examiner*—Bryon P Gehman
(74) *Attorney, Agent, or Firm*—Young & Thompson

(57) ABSTRACT

A wetting vessel (6) designed to contain an element made of absorbent material (8) saturated in its lower part with wetting liquid and including elements (80) for decanting pigments if any contained in the wetting liquid. In accordance with one possible embodiment, the decantation elements are studs (80) whereon is set the absorbent material and the vessel (6) has a lid (7) defining an open wetting compartment for the absorbent wetting material (8) and a drying compartment including a drying absorbent material (9) set on a base forming a sieve. The paint can include a series of paint blocks (4) arranged so as to provide projecting each side by side a paint surface constituting a common dipping surface for a paint brush (4*d*) of the type having a foam dipping spatula.

18 Claims, 3 Drawing Sheets

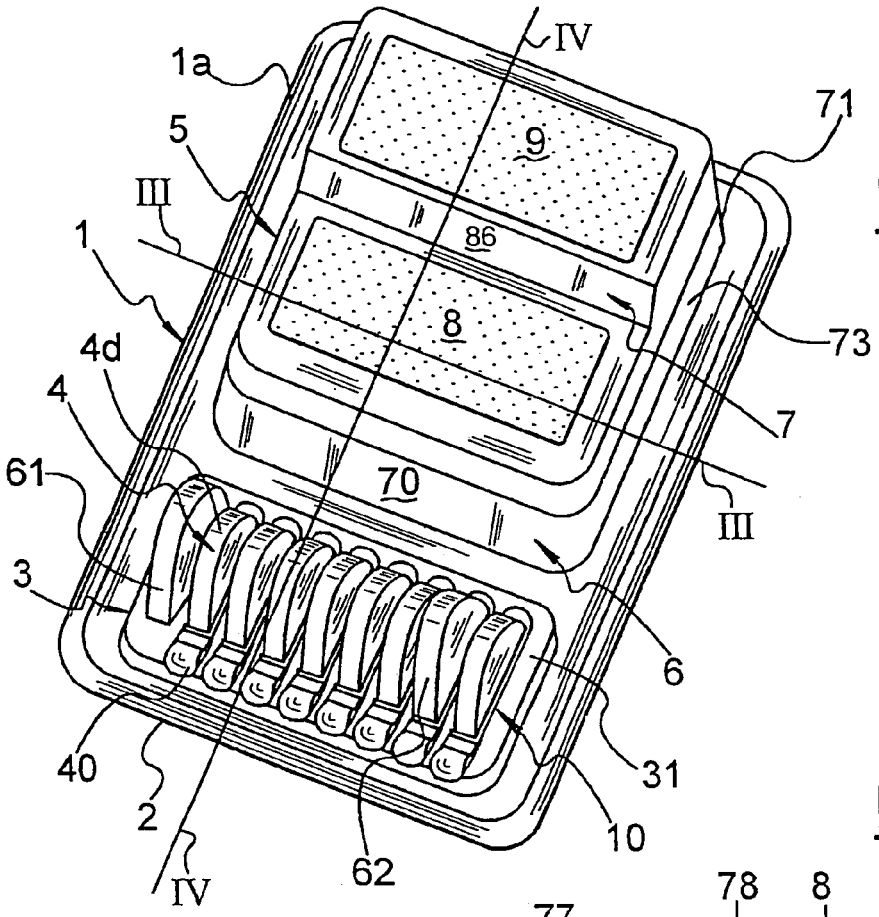
FIG.1
FIG.3
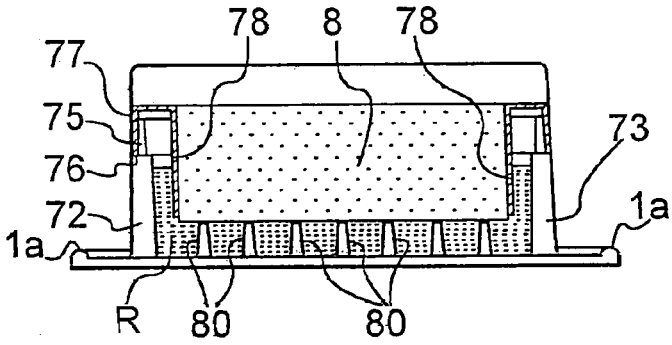
FIG.13
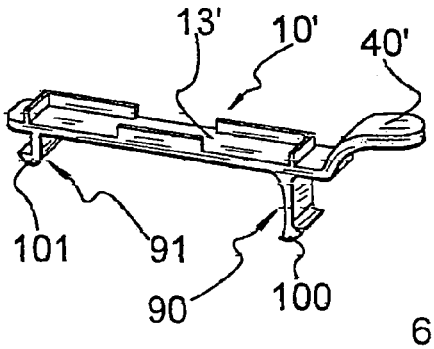
FIG.4
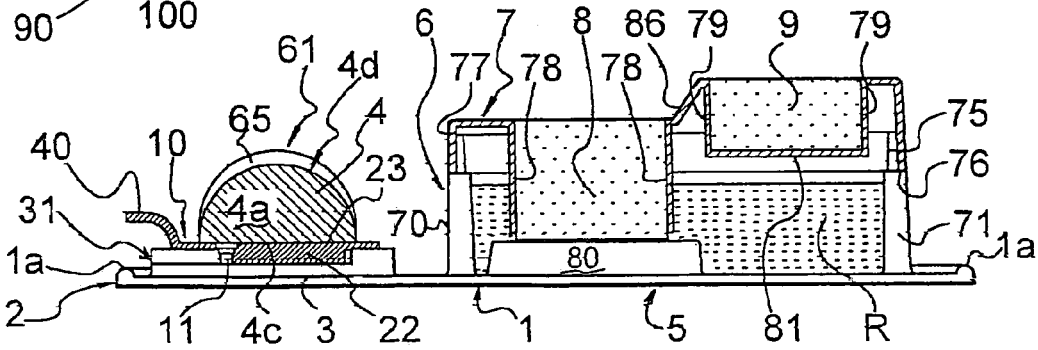

WETTING VESSEL FOR PAINT BRUSH AND PAINT BLOCKS EQUIPPED THEREWITH

The present invention relates to a wetting vessel for a paint brush, in particular of the type comprising a transverse application spatula made of absorbent material, and a paint box equipped therewith.

More particularly, it relates to a box of the type described in the U.S. Pat. No. 5,318,171 comprising a series of paint blocks of different colours, arranged side by side so as to provide, in a projecting fashion, each side by side a paint surface comprising a common take-up surface for a suitable paint brush (for example a paint brush with an extended edge made of absorbent material). The box can contain several paint brushes of different sizes capable of simultaneously taking up two or more colours. Moreover, the paint box can comprise wetting means constituted by a vessel in which a sponge is arranged which is intended to be saturated in its lower part with water and drying means also constituted by a vessel in which lies a sponge which is dry at the start.

The specific arrangement of the paint blocks, in a projecting fashion, side by side advantageously allows simultaneous take up of several colours with the same paint brush. The user can then spread the paint which has been taken up by the paint brush on a piece of paper by "drawing out" the colours in the manner of a rainbow or by using the edge of the paint brush to make stamp effects. By playing with the direction of movement of the paint brush relative to its extended edge, it is also possible to easily make several patterns, circles, waves, geometric figures, relief effects, calligraphy, etc.

A paint box of this type is therefore very useful in particular for stimulating young children or handicapped people, in particular because these children or people are easily pleased by the simple and fun production of very pretty drawings (surprising result).

However, the paint box described in the U.S. Pat. No. 5,318,171 presents the following drawbacks which spoil these stimulation characteristics:

- the colours of the paint blocks are very quickly mixed if the child does not take up the paint in the axis of the blocks;
- the sponges also become dirty very quickly;
- the paint brushes proposed have too large a foam part which is difficult to rinse and dry properly; and
- there is no possibility of modifying the colour combinations.

The present invention in particular aims to overcome these drawbacks.

According to a first object, it proposes a paint box comprising a series of paint blocks arranged side by side so as to provide, in a projecting fashion, each side by side a paint surface comprising a common take-up surface for a paint brush, characterized by two lateral stops flanking said series of paint blocks so as to define a paint take-up channel for said paint brush.

The paint brush can thus be guided during its movement on the paint take-up surface in a channel corresponding to a general direction of the paint blocks. Therefore there is no longer a risk that a colour which has already been taken up coats an adjacent block by mistake or through lack of dexterity.

According to a second object, the invention is characterized in that the paint blocks are interchangeable so as to define a take-up strip which can be composed of a different series of colours. For this, each paint block is mounted for example on a support comprising fastening means which are able to cooperate with complementary fastening means provided in said box, all of the supports and fastening means being identical so as to allow interchangeability of said paint blocks. Also according to the invention, one of the stops is fixed and the other can be interchangeable with one of the paint blocks so as to define a smaller take-up channel, said stop being mounted on a support comprising fastening means similar to the fastening means of the paint blocks so as to allow interchangeability between said stop and any one of the paint blocks. This characteristic also increases the number of possible colour combinations.

The paint box advantageously contains a set of paint brushes, each paint brush comprising an end part made of absorbent material intended to take up paint and having a length which approximately corresponds to the width of a possible take-up channel or strip.

According to a third object, the present invention proposes means for wetting the paint brush or paint brushes comprising a vessel intended to contain an element made of absorbent material saturated in its lower part with wetting liquid, said vessel comprising means for decanting pigments contained, if appropriate, in said wetting liquid, for example decantation studs on which rests the element made of absorbent material. Moreover, means for drying a paint brush are provided, comprising according to the invention an element made of absorbent material arranged in a receptacle forming a sieve above a liquid reception vessel. According to an advantageous embodiment, allowing recovery of the liquid which has passed through the sieve, the reception vessel for this liquid is in communication with the wetting liquid vessel. More particularly also and advantageously carried out, a single wetting/drying vessel is used with on its base a part equipped with decantation studs and a lid of a vessel divided into an open part above said studs and a receptacle part in the form of a sieve.

Preferably, the absorbent material used for the wetting is a filtering material, allowing the flow of the water and pigments in order that the latter are not trapped in the material and can settle to the base of the vessel in the decantation area. This can be for example an open-cell aired foam material.

Preferably also, the material used for the drying is a very absorbent material, in order to absorb the water from the paint brush very quickly. This can for example be a felt type material, with very tight fibres, in particular made of viscose.

The paint box according to the invention can comprise a plate produced all in one block, for example, by moulding a plastic material, comprising along the front edge an area intended for the paint blocks, said paint take-up channel or strip extending approximately perpendicular to said front edge, a wetting vessel being situated behind said paint area opposite said front edge. The wetting vessel is located behind the paint blocks in relation to the movement in the paint take-up channel which is carried out towards the front edge, with a wetting sponge extending over the width of all of the blocks, and not to the side as in the marketed model corresponding to the U.S. Pat. No. 5,318,171. This facilitates usage from an ergonomic point of view. The plate can also comprise beside a wetting/drying vessel an area for fixing the paint brushes for example by gripping their handle. In this case, a larger area for the paint blocks can advantageously be provided containing a greater number, for example, of blocks and therefore of colours.

According to a fourth object, the invention proposes a paint brush characterized by two parts, a first "applicator" part comprising a spatula covered with an absorbent material one of whose extended edges serves as an area for taking up and applying paint and a second part constituted by the handle of the paint brush having at one of its ends a fastener with a continuous U-shaped section intended to firmly grip the edge of said spatula opposite the paint take-up edge. In this way, the two flat arms of the U-shaped element can each cover a part of the spatula made of absorbent material and thus limit the usable width to the width which is really useful in practice namely the front edge of the paint brush. Thus the absorption of pigments on the paint brush is limited to the part which in practice will really be used to paint (the front edge of the paint brush) and as a result the paint brush is rinsed more quickly and the wetting and drying sponges do not get dirty as quickly. On the other hand, the restriction of the usable foam part allows a saving of coloured material.

According to an embodiment which is advantageous from an economic point of view, the two parts of the paint brush can be separated with a disposable part comprising the application strip made of absorbent material on one side and, on the other side, a reusable handle. Thus, according to a possible embodiment, the first part is constituted by a core of rigid material surrounded by a strip of absorbent material with a U-shaped section, the edge corresponding to the bend of said strip constituting the paint take-up edge. The core has, on the side opposite said edge, a thicker back edge intended to be inserted laterally into the element with a U-shaped section, this latter having a base with a shape which is complementary to said thicker edge so that the paint brush part cannot however be released along the axis of the handle. In a variant an assembly system of the clamp type can also be used, the two tabs of the fastener being able to grip between them the applicator strip by a standard system of pushing the tabs towards each other at rest.

The present invention will be better understood and other advantages will become apparent in light of the following description of an embodiment, which refers to the drawings in which:

FIG. 1 is a schematic view in perspective of the entire paint box according to said embodiment of the invention;

FIG. 3 is a cross section view along line III-III of FIG. 1;

FIG. 4 is a cross section view along line IV-IV of FIG. 1;

FIG. 13 shows a variant embodiment of the fastening means of the paint block support.

Figure 2:
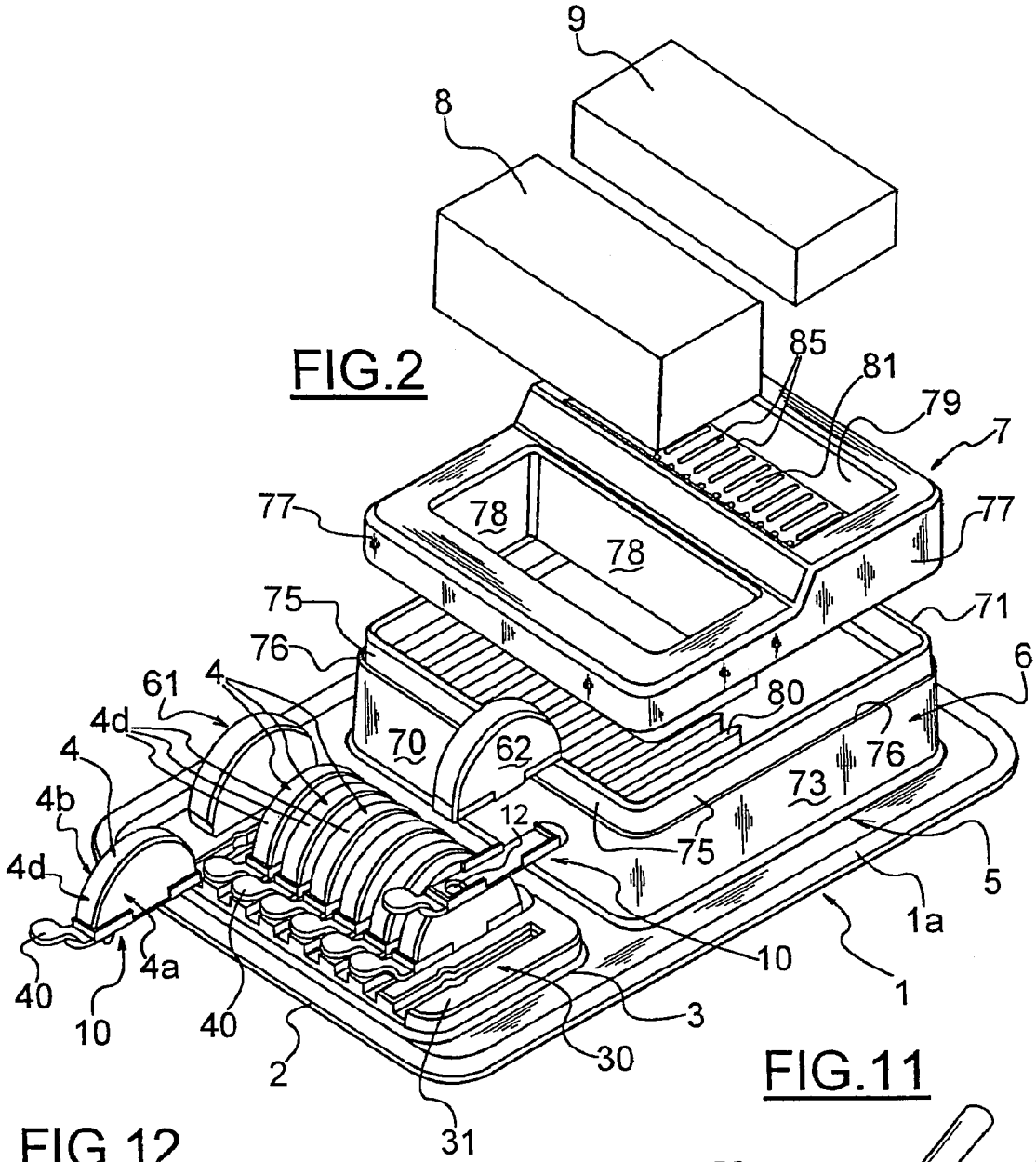
FIG. 2 is a similar view to FIG. 1 showing in exploded view the different elements constituting the box.

According to the example chosen and represented in the figures, the paint box comprises a plate 1 on which are defined, close to a front edge 2, an area 3 with paint blocks 4 and a part 5 for wetting/drying a paint brush or paint brushes at the back of the area 3, constituted essentially by a vessel 6 equipped with a lid 7 for two elements made of absorbent materials, a wetting sponge 8 and a drying sponge 9. The plate 1 comprises on its internal surface non-slip studs (not shown on the figures) and the periphery of its upper surface comprises a rim 1*a*, if appropriate, preventing the water from flowing out of the plate. Moreover, the paint box comprises a set of paint brushes, for example of the type represented in FIG. 11 and described later.

Figure 8:
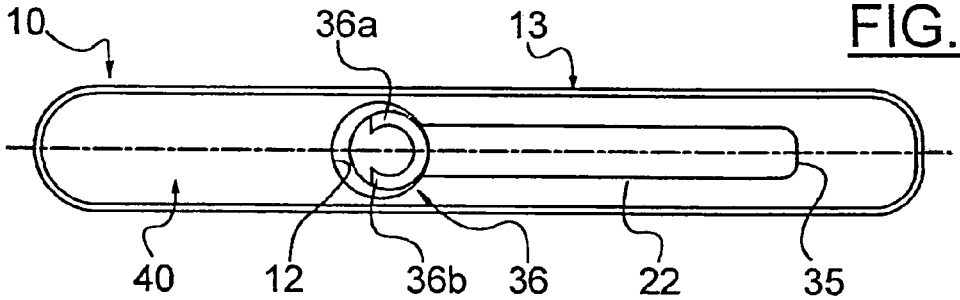
FIG. 8 is a base view of the support of the paint block or of the stop.
Figure 9:
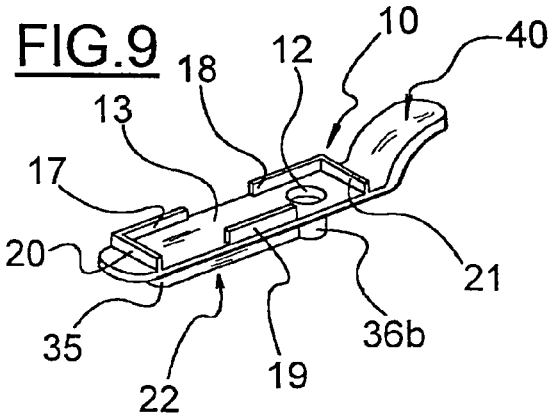
FIG. 9 is a perspective view of the support of FIG. 8.

Each paint block 4 has the general shape of a half disc here, namely a half section of cylinder, with two opposite lateral surfaces 4*a* and 4*b*; a flat lower surface 4*c*, approximately corresponding to the diameter of the cylinder and serving to fix it to a part forming a base plate 13 of a fastening bracket 10 (see FIGS. 8 and 9), and a section 4*d* providing a semi-cylindrical surface for taking up paint using a paint brush. The base plate 13 of the fastening bracket 10 comprises, in order to frame the base of the half disc 4, small walls 17 and 18 projecting over a longitudinal edge, and 19 over the opposite longitudinal edge. Similarly, two small walls 20 and 21 are arranged on the base plate 13 in order to frame the base of the section 4*d* of the half disc. Moreover, all of the small walls forming a discontinuous wall at the base of the paint block advantageously encourage the draining of liquid towards the plate, which liquid would otherwise corrode and wear the paint block unnecessarily at its base. Each block is attached to the base plate 13 of a support 10. The paint box thus comprises a group of paint blocks 4 which are identical but of different colours, each mounted on an identical support 10. This allows, according to the invention, an interchangeability of the paint blocks on the plate 1 and therefore changing of the position of the colours in relation to each other.

Figure 10:
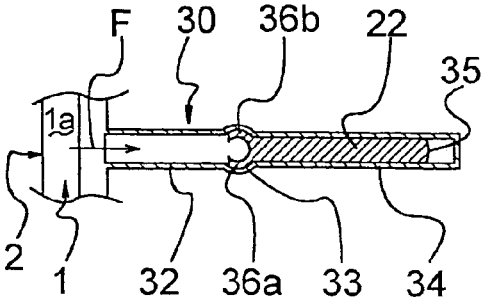
FIG. 10 is a cross section view illustrating the assembly of a support of the paint block or of the stop on the plate of FIG. 5.

The means for fastening a block 4 on the plate 1 comprise, projecting over the base of the base plate 13 of the support 10 a groove 22 extending longitudinally. This groove is able to cooperate with a slide, such as 30, arranged on the plate 1 in the area 3 provided for the paint blocks. The plate 1 comprises a series of identical slides 30 arranged side by side and extending in directions parallel to each other so that the half discs of paint have a good orientation in space once fixed side by side on the plate, as in FIG. 1. The slides 30 are formed in a raised part 31 of the plate 1 and open onto the edge of this raised part situated facing the front edge 2 of the plate 1. Each slide 30 is made up, from the open end, of an introductory portion 32 with straight parallel walls, a locking seat 33 with walls in the shape of an arc and a base portion 34 again with straight and parallel walls. In order to facilitate the introduction of the groove 22 of a support 10, said groove comprises an introductory end 35 which is rounded. In order to fasten and lock the support 10 in a slide 30, the groove 22 of the support 10 comprises an enlarged portion 36, forming a stop, situated here at the end opposite to the introductory end 34, composed of two walls in the shape of an arc 36*a*, 36*b* opposite each other. The stop 36 complements the locking seat 33 of a slide (see FIG. 10). In order to facilitate the placement of the supports, without touching the paint block which can be dirty, these are equipped with a gripping tab 40 situated in the extension of the end of the base plate 13 opposite the introductory end 35 of the fastening groove 22. Moreover, in order to facilitate the introduction of the groove 22 into a slide 30, the introductory portion 32 of the latter is enlarged in relation to the base portion 34 which is adjusted to the width of the groove 22 to ensure it is held. Moreover, the walls in the shape of an arc 36*a* and 36*b* of the stop 36 have a certain elasticity in relation to the rest of the groove allowing them to be brought towards each other in order to engage in the portion 32 of a slide 30 before locking tightly into the locking seat 33. The placement of a support is thus carried out by introducing the groove 22 into the slide 30 chosen according to the arrow 10 of FIG. 10 and up to locking the stop 36 of said groove in the seat 33 complementary to the slide. This locking in position of the groove also allows definition of the correct position with respect to each disc of paint. In order to remove a paint block, it is then only necessary to lift the support 10 using its gripping tab 40 in order to release the stop 36 from its locking seat 33.

The different paint blocks 4 can thus be fixed on the plate 1, situated side by side with their lateral surfaces 4*a*, 4*b* facing each other, with only their section 4*d* accessible as a result, all of these sections 4*d*, evening out at the same level, forming a common paint take-up surface with approximately semi-cylindrical shape, for a wet paint brush. The paint take up from several blocks is carried out thanks to a particular paint brush design (see FIGS. 11 and 12), comprising an application spatula 50 covered with an absorbent material, having a flattened shape and being long enough to cover at least two sections 4*d* of paint blocks 4. Such a paint brush, having the characteristics according to the invention, is described in detail later. The gap between the paint blocks is preferably fixed so that the colours taken up simultaneously, once applied on the support, are sufficiently contrasted with respect to each other with a slight transition between the colours.

According to the invention, in order to guide the paint take up on the paint blocks, in a general direction, here approximately in the semi-cylindrical section 4*d* of the blocks, perpendicular to the front edge 2 of the plate 1, two lateral stops 61 and 62 are arranged, intended to define a paint take up channel adapted to the width of the application spatula 50 of a paint brush. One of the stops, 61 here, is fixed, produced for example all in one block by moulding to the plate 1 or bonded to it. It is placed beside one of the two slides 30 which is situated at the end of the series of slides. Here it has a similar shape to that of the paint blocks 4, approximately in a half section of a cylinder, and extends in a plane parallel to the parallel planes in which the different blocks 4 extend, but has a height which is greater than said blocks as is seen in profile in FIG. 4. The projecting part 65 presenting a half moon with respect to the stop 61 performs the function of a lateral stop and therefore guiding the paint brush along the edge of the section 4*d* of the last block of the series of blocks.

Figure 6:
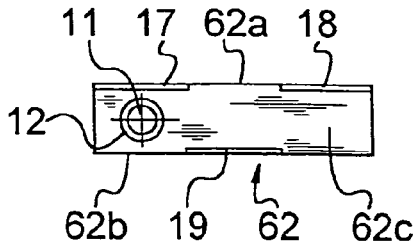
FIG. 6 is a base view of the detachable lateral stop.
Figure 7:
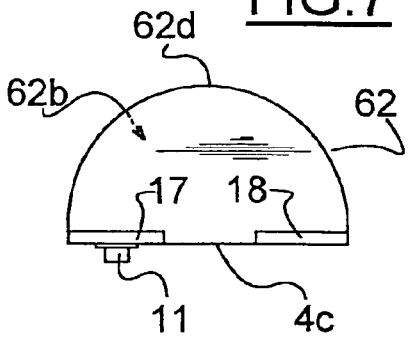
FIG. 7 is a side view of the detachable lateral stop of FIG. 6.

The other lateral stop 62 is detachable, interchangeable with one of the paint blocks. FIGS. 6 and 7 represent this stop 62 fixed on a fastening bracket 10 (the gripping tab 40 is omitted). In order to allow interchangeability, as is seen in FIGS. 6 and 7, the stop 62 has a shape similar to that of the paint blocks 4, in the shape of a semi cylindrical half disc, with a front surface 62*a*, a back surface 62*b*, a flat lower surface 62*c* and a section 62*d*. The dimensions of the stop 62 are similar to those of a paint block in width and thickness (in particular in order to be able to be fixed on the base plate 13 of the support) and, as for the fixed lateral stop 61, a greater height in order to be able to perform the function of a stop and of lateral guiding along the edge of a section 4*d* of an adjacent block. In FIG. 1, as an example this detachable stop 62 is represented in the second position from the right on the plate 1, defining a channel for take up from six colours. For its fixation on a base plate 13, relative to the paint blocks 4, the stop 62, because it can be produced by moulding, also comprises on its flat lower surface 62*c*, close to one end, a circular tenon 11 intended to engage in a hole of complimentary shape 12 present in the base plate 13 of the fastening bracket 10 (the hole resulting from constraints relating to moulding the support 10).

Figure 11:
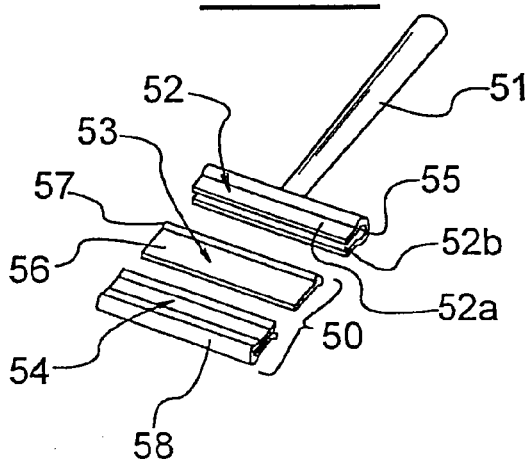
FIG. 11 is a perspective view showing in exploded view the different parts of a paint brush according to a possible embodiment of the invention.
Figure 12:
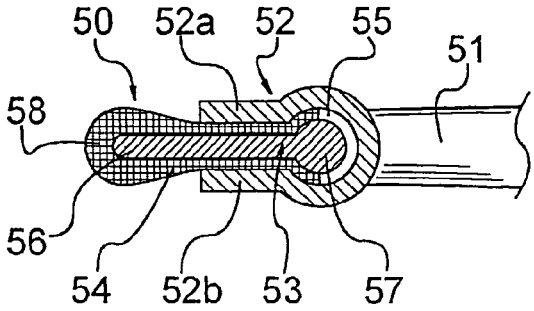
FIG. 12 is a longitudinal cross section view of the paint brush of FIG. 11 along the axis of the handle of the paint brush.

An example of a paint brush according to the invention is shown in FIGS. 11 and 12. It is constituted by two parts: on the one hand a handle 51 with a fastener 52 extending transversally in the same plane as that containing the handle 51, with a continuous general U-shaped section, and, on the other hand, the application spatula 50 made of absorbent material mentioned above, itself constituted by a core 53 made of rigid material and a strip 54 of absorbent material with a general U-shaped section. More particularly, the fastener 52 with a U-shaped section comprises two flat parallel arms 52*a* and 52*b* and a base which is enlarged and rounded to form a retaining groove 55. The core 53 of the application spatula 50 comprises a flat rectangular tab 56 with a bead 57 with a circular cross section arranged on one of the longitudinal edges intended to be inserted laterally into the groove 55 of the transverse end part of the handle, as is seen in FIG. 12. The part made of absorbent material 54 is intended to practically cover the core 53 up to the middle of the bead 57. It is fixed by bonding. The front end 58, forming the area of the paint brush which completes the take up of the paint, is rounded and slightly curved to provide a continuous and flexible shape for the application of the paint. The application spatula 50 and the handle 51 are assembled by laterally inserting the bead 57 into the groove 55 which produces locking perpendicular to the bead and to the groove. The arms 52*a* and 52*b* thus cover and limit the width of the absorbent part only leaving uncovered the front end 58 representing a surface which is sufficient to take up and apply the paint while being easy to rinse and dry. In practice, thanks to this design in a handle part and an applicator part, it is possible firstly to produce, in particular by extrusion, a long application strip made from a long strip of absorbent material bonded to a long rigid core and to then cut out application strips such as 50, in particular also with different widths. Thanks also to the assembly means which are simple to use, an application part which is disposable can be designed. Moreover, the paint box can contain an additional paint brush with an application strip which is able to take up paint on one paint block only.

The wetting/drying part according to the invention will now be described. It comprises, as was seen above, a single vessel 6 with a front wall 70 opposite the area 5 for the paint blocks, an opposite back wall 71, a left-hand side wall 72 and a side wall 73. The base of the vessel 6 is flat and has an area called a decantation area defined by a series of extended studs 80 arranged parallel to each other and parallel to the side walls 72 and 73. The studs 80 extend over approximately the front half of the base of the vessel from the front wall 70. The wetting sponge 8 is intended to be placed on the studs 80, the latter extending in the direction of the width of the sponge. As is seen in particular in FIG. 2 and in cross section in FIGS. 3 and 4, the upper periphery 75 of the walls of the vessel 6 has a reduced thickness so as to define a peripheral rim 76 onto which the end of the outer skirt 77 of the lid 7 of the vessel is set, so as to define continuous outer walls between the lid and the vessel when the lid is installed on the vessel. The lid 7 comprises an upper wall in which two compartments are formed, one corresponding to the wetting part and the other to the drying part for the paint brush or paint brushes.

The wetting compartment is defined by an inner skirt 78, forming an approximately parallelepipedic housing with an open base for the sponge 8. This latter has a complementary parallelepipedic shape, if appropriate, slightly larger so that it can be held against the inner skirt 78 by means of a slight compression of the material. The skirt 78 extends preferably approximately up to the decantation studs 80. The parallelepipedic housing extends overall over a width corresponding to the width of the largest possible paint take-up channel in the area 5 and therefore to the largest paint brush. In one variant, the skirt 78 can be perforated or have cut-outs in order to increase the flow of the water in the sponge 8. The material used for the sponge 8 is preferably an absorbent material, in order to be able to be saturated in its lower part with wetting water, but which must also be filtering so that the pigments discharged by the paint brushes do not stay trapped in the sponge and can be decanted. This can be, for example, an open-cell synthetic foam material currently used in water pumps to filter water.

The drying compartment of the lid 7 is also defined in the lid by an inner skirt 79 forming a parallelepipedic housing for the drying sponge, but this time with a pierced base 81 forming a sieve. The holes for draining the water absorbed by the drying sponge 9 by gravity are constituted here by two series of slits 85 extending parallel to the width of the pierced base 81. As is clearly seen in FIG. 4 in particular, the drying compartment is raised in relation to the wetting compartment so that the vessel 7 can be filled with water so as to soak the lower half of the wetting sponge 8 without the pierced base 81 of the drying compartment being in contact with the water and risking wetting the drying sponge 9. An inclined connecting wall 86 joins the two levels. The material used for the sponge 9 is preferably a material having a very strong absorbency, of the baize type, made of very tight non-woven fibres, such as viscose fibres, in order to be able to be very effective and rapid.

The level of the water reserve R corresponding to the optimum appropriate use of the paint box is represented in FIGS. 3 and 4. The level corresponds to an immersion of the lower half of the wetting sponge 8, while the drying sponge 9 is situated above.

Figure 5:
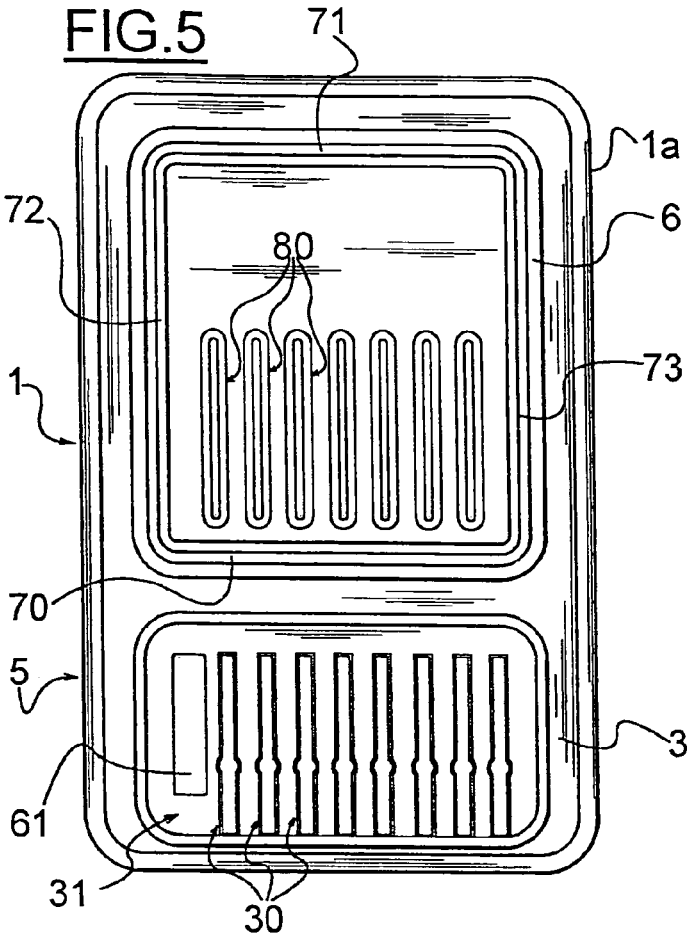
FIG. 5 is a top view of the plate of the box according to the preceding figures.

The plate 1, the raised area 31 with the lateral stop 61 and the parallel slides 30, as well as the vessel 6 and the decantation studs 80 can advantageously be produced all in one block by moulding of an appropriate synthetic material and can constitute a single part as is represented in FIG. 5. The other parts, such as the lid 7, the supports 10 and the detachable stop 62 can also be produced by moulding of a synthetic material.

The paint box is used in the following way. A group of paint blocks 4 each secured on a support 10 is chosen and fixed on the slides 30 in an order which is also chosen. The first paint block of the series is placed beside the fixed stop 61 then the others side by side and finally the lateral detachable stop 62 is fixed. The user chooses a paint brush corresponding to the width of the take up channel defined between the two stops. He applies the end part made of absorbent material 58 to the wetting sponge 8 in order to dampen it. He takes up some paint by guiding the paint brush in the channel between the stops preferably starting from the end of the section 4*d* of the paint blocks situated close to the wall 70 of the vessel 7 towards the other end of the section 4*d* close to the edge 2 of the plate 1. He can then apply the paint taken up to any support. In order to then clean the paint brush and refresh or change its colours, the user wets it on the sponge 8 as much as possible so that the pigments are diluted in the water and he dries his paint brush on the drying sponge 9 if this is then necessary. The released pigments will then be decanted under the sponge 8 between the decantation studs 80, which allows some water to remain in contact with the wetting sponge which remains clean longer compared to a vessel without decantation studs. In order to interchange the paint blocks, it is sufficient to then lift them using the gripping tab 40 and to put them down again in the desired place.

Variant embodiments are of course possible, in particular, the shape of the paint blocks is not necessarily in a half cylinder but can be for example such that it provides a flat take-up surface, optionally inclined. Moreover, the general shape of the stops is also not necessarily the same as that of the paint blocks.

In FIG. 13 a variant 10' embodiment of the support element 10 for the paint blocks is represented, characterized in that the fastening means provided beneath the base plate 13' are constituted not by a groove intended to cooperate with a slide, but by two locking tabs. A tab 90 is arranged beside the gripping tab 40' and the other tab 91 close to the opposite end. They each have an end curved in the shape of a hook 100, 101 orientated towards the outside each of which is able to cooperate with a rim arranged for this purpose in the plate 1.

Moreover, the present invention includes as a subject a paint box which comprises only the area for the paint blocks, the paint brushes and the cleaning/rinsing vessel being proposed only as an option. More precisely, in this case it includes an area for paint blocks characterized by paint blocks which are interchangeable and optionally only with the lateral stops, and possibly, also optionally, one of the interchangeable lateral stops with a paint block. It also includes as a subject an area for paint blocks characterized by two fixed stops and optionally only the interchangeability of the paint blocks.

Moreover, the present invention includes as single objects, independently of the characteristics of the area for the paint blocks, a wetting/drying vessel on the one hand and on the other hand a paint brush, as described in the present application.

The invention claimed is:

1. Wetting vessel for a paint brush, comprising:

a first element made of absorbent material intended to be saturated in its lower part with wetting liquid, wherein said first element comprises means for decantation of pigments contained in the wetting liquid;

means for drying the paint brush comprising a second element made of absorbent material arranged in a housing forming a sieve above a liquid reception vessel; and a series of paint blocks arranged side by side so as to provide, in a projecting fashion, a paint surface comprising a common take-up surface for a paint brush.

2. Paint box according to claim 1, characterized by two lateral stops flanking said series of paint blocks so as to define a paint take-up channel.

3. Paint box according to claim 2, characterized in that one of the stops is interchangeable with one of the paint blocks so as to define a smaller take-up channel, said stop being mounted on a support comprising fastening means similar to fastening means of the paint blocks so as to allow interchangeability between said stop and any one or the paint blocks.

4. Paint box according to claim 1, characterized in that the paint, blocks are interchangeable so as to define a take-up channel which can be composed of a different series of colours.

5. Paint box according to claim 4, characterized in that each paint block is mounted on a support comprising fastening means which are able to cooperate with complementary fastening means arranged in said box, all of the supports and fastening means being identical so as to allow interchangeability of said paint blocks.

6. Paint box according to claim 5, characterized in that some of the fastening means are grooves and slides.

7. Paint box according to claim 5, characterized in that some of the fastening means are locking means.

8. Paint box according to claim 5, characterized in that at least some of the supports comprise:

an extended base plate equipped with means for holding a corresponding one of the paint blocks or a detachable lateral stop;

a gripping tab arranged at one of the ends of said base plate; and a corresponding one of the fastening means with the paint box projecting under said base plate.

9. Paint box according to claim 8, characterized in that the fastening means comprise a groove, the two opposite lateral surfaces of which, at the gripping tab end of the base plate, widen into an arc so as to form a stop with rounded walls.

10. Paint box according to claim 9, characterized in that the complementary fastening means arranged in said box comprise a slide having an introductory portion, a portion with parallel lateral walls, a portion with lateral walls widened into an arc forming a seat for the stop and a base portion with parallel lateral walls adjusted to the width of the groove.

11. Paint box according to claim 1, characterized in that it comprises a set of paint brushes, each paint brush comprising an application spatula covered with an absorbent material intended to take up paint and having approximately the width of a take-up channel.

12. Paint box according to claim 1, characterized in that it comprises an additional paint brush with an application spatula which is able to take up paint from a single paint block.

13. Paint box according to claim 1, characterized by a plate produced all in one block by moulding, comprising close to a front edge an area intended for the paint blocks, a paint take-up channel extending approximately perpendicular to said front edge, the wetting vessel being situated behind a paint area opposite said front edge.

14. Paint box according to claim 1, characterized by a paint brush made of two parts, a first part forming an application spatula made of absorbent material, one extended edge of which spatula serves to take up paint and a second part constituted by the handle of the paint brush having at one of its ends a fastener with a continuous U-shaped section, extending in a plane of the handle and transversally, intended to firmly grip the edge of said spatula opposite the paint take-up edge.

15. Paint box according to claim 14, characterized in that the two parts can be separated.

16. Paint box according to claim 14, characterized in that the first part forming the application spatula is constituted by a core made of rigid material surrounded by a strip of absorbent material with a U-shaped section, the edge corresponding to a bend constituting the paint take-up edge.

17. Paint box according to claim 16, characterized in that the rigid material defines a core that has, on the side opposite said take-up edge, a back edge which is thicker, intended to be inserted laterally into the element of the U-section, the element of the U-section having a base with a shape which complements said thicker edge so that the applicator part cannot be released along the axis of the handle.

18. Paint box according to claim 14, characterized in that the fastener is a clamp.

* * * * *